United States Patent [19]

Zaslavsky et al.

[11] Patent Number: 4,818,915

[45] Date of Patent: Apr. 4, 1989

[54] ARC DISCHARGE LAMP WITH ULTRAVIOLET RADIATION STARTING SOURCE

[75] Inventors: Gregory Zaslavsky, Brookline; Nikolaos Barakitis, Salem; William M. Keeffe, Rockport, all of Mass.

[73] Assignee: GTE Products Corporation, Danvers, Mass.

[21] Appl. No.: 111,395

[22] Filed: Oct. 22, 1987

[51] Int. Cl.[4] ..... H01J 7/44

[52] U.S. Cl. ..... 315/60; 315/267; 315/59; 315/150; 315/289

[58] Field of Search ..... 315/60, 47, 45, 248, 315/59, 44, 150, , 289, 248, 331; 250/372, 373, 504 R; 313/54, 197, 214, 229

[56] References Cited

U.S. PATENT DOCUMENTS

| | | | |
|---|---|---|---|
| 3,226,597 | 12/1965 | Green | 315/60 |
| 3,900,761 | 8/1975 | Freese et al. | 315/60 |
| 4,041,352 | 8/1977 | McNeill et al. | 315/248 |
| 4,053,814 | 10/1977 | Regan et al. | 315/248 |
| 4,097,777 | 6/1978 | Bacharowski | 315/60 |
| 4,325,004 | 4/1982 | Proud et al. | 315/45 |
| 4,328,446 | 5/1982 | Fallier et al. | 315/47 |
| 4,355,261 | 10/1982 | Cohen et al. | 315/47 |
| 4,721,888 | 1/1988 | Proud et al. | 315/60 |

*Primary Examiner*—Leo H. Boudreau
*Assistant Examiner*—Michael Razavi
*Attorney, Agent, or Firm*—Carlo S. Bessone

[57] ABSTRACT

A metal halide arc discharge lamp comprises an arc tube containing a chemical fill including mercury and metal halides and having first and second electrodes respectively sealed at opposite ends thereof. An outer envelope surrounds the arc tube and has first and second terminals for electrical connection thereto. A source of ultraviolet radiation is provided within the outer envelope proximate the arc tube for producing radiation which illuminates the path between the electrodes of the arc tube to decrease the amount of time for generating a gaseous discharge therebetween. The ultraviolet light source includes an envelope of ultraviolet light transmitting material containing a fill material and having a single electrode sealed in one end thereof. The single electrode is electrically coupled to one electrode of the arc tube. A portion of the envelope of the ultraviolet light source is capacitively coupled to the other electrode of the arc tube such that the source produces ultraviolet radiation during lamp starting when the first and second terminals of the lamp are energized.

14 Claims, 4 Drawing Sheets

ARC DISCHARGE LAMP WITH ULTRAVIOLET RADIATION STARTING SOURCE

CROSS-REFERENCE TO A RELATED APPLICATION

This application discloses, but does not claim, inventions which are claimed in U.S. Ser. No. 111,396 filed concurrently herewith, and assigned to the Assignee of this application.

TECHNICAL FIELD

This invention relates to the starting of high pressure metal vapor arc discharge lamps and is especially useful with such lamps having a metallic halide fill.

BACKGROUND OF THE INVENTION

High-pressure metal halide arc discharge lamps generally comprise an elongated arc tube containing an ionizable fill and having press seals at each end of the tube. Disposed within the arc tube are two main electrodes, one at each end. The electrodes are generally supported in the press seals and are usually connected to a thin molybdenum ribbon, disposed within the press seal, the purpose of the ribbon being to provide an electrical feedthrough of low thermal expansion, owing to its thinness, while having sufficient current carrying capacity, owing to its width.

In order to facilitate starting of the gaseous discharge, a starter electrode may be disposed in the arc tube, adjacent to one of the main electrodes. Such an electrode is used because a discharge can be ignited between the starter electrode and its adjacent electrode at a much lower starting voltage than is required to ignite a discharge between the two main electrodes. Once the discharge is ignited, the ionized gas provides primary electrons between the two main electrodes and if enough potential is available between the main electrodes a discharge will be formed therebetween. The starter electrode normally has a resistor in series with it to limit the current flowing through the starter electrode after the discharge has started.

However, the press sealed electrical feedthrough for the starting electrode suffers a sodium electrolysis failure mechanism which leads to premature seal failure and this is made worse at the elevated seal temperatures associated with the newer low color temperature, high efficiency metal halide lamps. For these reasons, the starter electrode approach has been abandoned in favor of a high voltage starting pulse applied directly to the main electrodes of the arc tube. With this method the seal failure problems associated with the starting electrode have been overcome, however, there is a substantial statistical starting time between the time the high voltage is applied to the lamp electrodes and the gas breakdown time when the discharge occurs. By "statistical" starting time, it is meant that the breakdown or starting time for a given lamp and starting circuit is distributed over a range of values, such that, if the voltage is applied N times, the time at which breakdown occurs is distributed over a relatively wide range indicating that in some specific cases, the starting time is relatively short and in some cases, relatively long.

BRIEF SUMMARY OF THE INVENTION

It is, therefore, an object of the present invention to obviate the disadvantages of the prior art.

It is still another object of the invention to provide an improved metal halide arc discharge lamp having a decreased statistical starting time between the time the high voltage is applied to the lamp terminals and the time discharge occurs.

These objects are accomplished in one aspect of the invention by the provision of a metal halide arc discharge lamp comprising an arc tube containing a chemical fill including mercury and metal halides and having first and second electrodes respectively sealed at opposite ends thereof. An outer envelope surrounds the arc tube and has first and second terminals for electrical connection thereto. The lamp further includes means for electrically coupling each of the electrodes of the arc tube to a respective terminal. A source of ultraviolet radiation is provided within the outer envelope proximate the arc tube for producing radiation which illuminates the path between the electrodes of the arc tube to decrease the amount of time for generating a gaseous discharge therebetween.

The source of ultraviolet radiation comprises an envelope of ultraviolet light transmitting material, a fill material contained within the envelope of the source of ultraviolet radiation and a single electrode sealed in the envelope of the ultraviolet radiation source. Means is provided for electrically coupling the single electrode to the means for electrically coupling the first electrode of the arc tube to the first terminal. A portion of the envelope of the source of ultraviolet radiation is capacitively coupled to the means for electrically coupling the second electrode of the arc tube to the second terminal such that the source of ultraviolet radiation produces the ultraviolet radiation during lamp starting when the first and second terminals of the lamp are energized.

In accordance with further teachings of the present invention, a portion of the envelope of the source of ultraviolet radiation and said means for electrically coupling said second electrode of said arc tube to the second terminal are in a contiguous relationship.

In accordance with further aspects of the present invention, the envelope of the ultraviolet light source is quartz, Vycor or ultraviolet light transmitting borosilicate glass, having a transmission band extending to a short wave limit of 253.7 nanometers or less.

In accordance with still further teachings of the present invention, a getter means is located within the envelope of the ultraviolet light source and associated with the single electrode. Preferably, the electrode has means formed thereon to lower the breakdown voltage of the source of ultraviolet radiation.

In accordance with still further aspects of the present invention, the means for electrically coupling the single electrode of the source of ultraviolet radiation to the means for electrically coupling the first electrode of the arc tube to the first terminal may include a foil (e.g., molybdenum) sealed in one end of the envelope of the ultraviolet light source and a lead-in conductor attached to the foil and extending outside of the envelope of the ultraviolet light source. Alternatively, a direct seal between expansion-matched glass and lead-in material may provide the coupling.

In accordance with still further aspects of the present invention, the metal halide arc discharge lamp further includes a contact coupling a portion of the external surface of the envelope of the ultraviolet light source to the means for electrically coupling the second electrode of the arc tube to the second terminal.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended Claims in connection with the above-described drawings.

Figure 1:
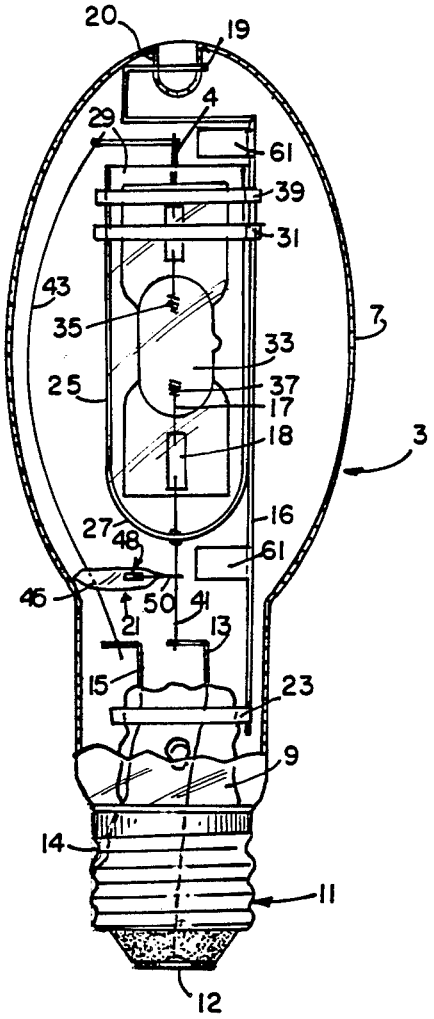
FIG. 1 represents a front elevational view, partially broken away, of an embodiment of a metal halide arc discharge lamp containing an ultraviolet light source according to the present invention.

Referring to the drawings, FIG. 1 illustrates a metal halide arc discharge lamp 3 which includes an evacuated outer envelope 7. Evacuated outer envelope 7 is hermetically sealed to a glass stem member 9. An external base 11, having first and second terminals 12 and 14, respectively, is affixed to the hermetically sealed stem member 9 and evacuated outer envelope 7 for connection to an electrical circuit. The shape of outer envelope 7 and the particular type of external base 11 used for the lamp may differ from that shown in FIG. 1. A pair of stem lead electrical conductors 13 and 15 are sealed into and pass through stem member 9 and are electrically connected to the terminals of base 11 external of evacuated outer envelope 7 to provide access for energization of the discharge lamp 3. Disposed within outer envelope 7 is an arc tube 33 having an ionizable radiation-generating chemical fill including mercury and metal halides which reach pressures of several atmospheres at normal operating temperatures from 600 to 800° C. One suitable fill comprises mercury, sodium iodide, scandium iodide, and an inert gas such as argon to facilitate starting and warm-up. Preferably, the fill includes iodides of sodium and scandium of a ratio in the range of about 20:1 to 28:1. Arc tube 33 also includes first and second electrodes 35 and 37, respectively sealed at opposite ends thereof. A metal outer strap member 39 is affixed to the outer surface of arc tube 33. Strap member 39 is electrically coupled to and mechanically connected to a support member 16.

Support member 16 extends along an axis parallel to the longitudinal axis of the discharge lamp 3 and includes at one end an annular configuration 19 adjacent and in register with an upper portion 20 of evacuated envelope 7. The other end of support member 16 is securely held by strap member 23 which extends around stem member 9, and is electrically isolated from the stem leads 13 and 15.

A heat loss reducing member 25 in the form of a quartz sleeve surrounds arc tube 33. Heat loss reducing member 25 may include a domed portion 27 positioned closest to base 11 and an open-ended portion 29 which is furthest from and faces away from base 11. A metal band 31 surrounds and is affixed to heat loss reducing member 25 and is electrically and mechanically connected to the support member 16.

Electrodes 35, 37 are mounted at opposite ends of arc tube 33, each including a shank portion 17 which extends to a molybdenum foil 18 to which an outer conductor lead 4, 41 is connected. The hermetic seals are made at the molybdenum foils upon which the fused silica of the pinches are pressed during the pinch sealing operation. Arc tube conductor lead 41 is connected to electrical conductor 13. Arc tube lead 4 is connected to a return lead 43, that is disposed adjacent heat loss reducing member 25, which is connected to conductor stem lead 15. Electrical conductors 13, 15 are respectively connected to terminals 12, 14 on a base 11 (e.g., screw base) attached to the neck end of envelope 7 thereby completing the lamp operating circuit.

Getters 61 are positioned within outer envelope 7 and attached to support member 16.

In accordance with the teachings of the instant invention, metal halide arc discharge lamp 3 further includes a source 21 of ultraviolet radiation (FIG. 2) located within outer envelope 7 and proximate arc tube 33 for producing radiation which illuminates the path between electrodes 35, 37 within arc tube 33 to decrease the amount of time for generating a gaseous discharge therebetween. The addition of a source of ultraviolet radiation adjacent the arc tube, which is activated concurrent with the application of high voltage across the electrodes, substantially lowers the statistical starting time and increases the probability of generating a gaseous discharge between the electrodes of the arc tube. Also, the resultant starting time is very narrowly distributed. The ultraviolet radiation produces photoelectrons in the discharge gap which enhances gas breakdown and hence the initiation of the discharge between the electrodes of the arc tube.

Figure 2:
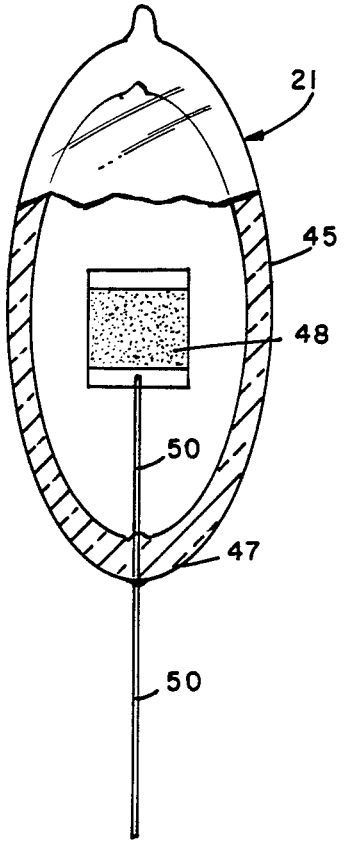
FIG. 2 is a front elevational view, partially broken away, of one embodiment of an ultraviolet light source.

With particular attention to the embodiment illustrated in FIG. 2, ultraviolet radiation source 21 includes an envelope 45 of ultraviolet light transmitting borosilicate glass having a transmission band extending to a short wave limit of 253.7 nanometers or less, such as 9741 available from Corning Glass Works. Envelope 45 has a seal 47 (e.g., direct or pinch seal) formed at one end thereof. Typically, the envelope in FIG. 2 has an outside diameter of 0.157 inch (4.0 millimeters), an inside diameter of 0.078 inch (2.0 millimeters), and an overall length of from 0.590 to 0.787 inch (15.0 to 20.0 millimeters). A single electrode 48 is sealed in envelope 45 and may include a getter means 49 supported by a lead 50 (e.g., Kovar wire) which in FIG. 2 extends outwardly through seal 47. A suitable material for getter means 49 is ST101/ST505 manufactured by SAES Getters S.p.A., Milan, Italy. The material chosen for getter means 49 can serve both as a gettering device and a mercury dispenser if mercury is to be included in the fill.

Figure 3A:
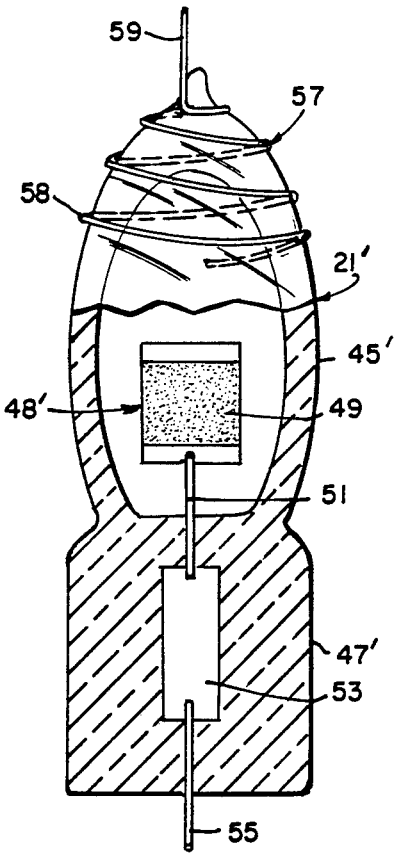
FIG. 3A is a front elevational view, partially broken away, of another embodiment of an ultraviolet light source.
Figure 3B:
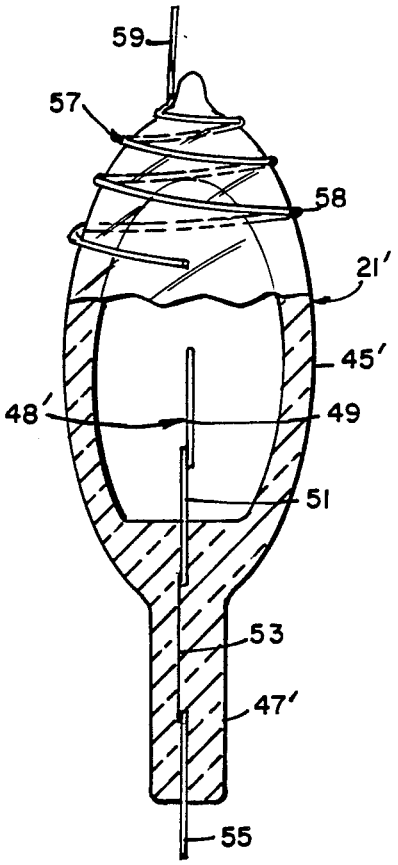
FIG. 3B is a side elevational view, partially broken away, of the ultraviolet light source of FIG. 3A.

In another embodiment of an ultraviolet light source as illustrated in FIGS. 3A and 3B, ultraviolet radiation source 21' includes an envelope 45' of ultraviolet light transmitting material such as pure fused silica (quartz)

or Vycor brand of high-silica glass (Corning Glass Works) having a press seal 47' formed at one end thereof. In FIGS. 3A and 3B, a single electrode 48' is sealed in envelope 45' and includes getter means 49 supported by a tungsten rod 51. Tungsten rod 51 is welded to a molybdenum foil member 53 embedded in press seal 47'. An outer lead 55 is welded at molybdenum foil 53. Alternatively, electrode 48' (or 48 in FIG. 2) may be constructed from thoriated tungsten. Although shown supported by a lead or rod, getter means 49 may by loose within the envelope. Pointed tips, edges, or corners may also be included on the electrode or attached getter to further lower the breakdown voltage.

A fill material including an inert gas or combinations thereof or in combination with a quantity of mercury is contained within the envelope of the ultraviolet source at a pressure within the range of from about 1 torr to 50 torr. The combinations may consist of so-called "Penning Mixtures". Preferably, the pressure is within the range of from about 5 torr to 15 torr.

The actual fill pressure of the ultraviolet light source is chosen as a compromise between the desired breakdown voltage of the source (which should ensure ignition with any possible output of the source) and the ultraviolet light output of the source. The intensity of the ultraviolet light generated and the breakdown voltage of the source increase as the fill pressure within the source is increased. In some cases, the compromise may be difficult to achieve. It has been discovered that one method of overcoming this problem is to capacitively couple one end of the ultraviolet light source. The single electrode which is located at the other end, insures lighting up of the source by decreasing the breakdown voltage so the compromise between output voltage and breakdown voltage can be achieved. A solid or gaseous radioactive source, such as americium 241 or krypton 85, may also be included in the fill to lower the breakdown voltage. Capacitively coupling the ultraviolet light source eliminates the need for a ballasting resistor in series with the source.

In the embodiment as illustrated in FIG. 1, a portion of envelope 45 of source 21 is capacitively coupled to return lead 43 such that ultraviolet source 21 produces ultraviolet radiation during lamp starting when terminals 12 and 14 of lamp 3 are energized. For adequate coupling, envelope 45 is spaced not more than about 0.5 inch (1.27 centimeters) from the coupling conductor. Preferably, envelope 45 is in a contiguous relationship with return lead 43. In FIG. 1, electrode 48 of ultraviolet light source 21, which includes a getter means supported by a rod, is electrically coupled through lead 50 to outer conductor lead 41. If the polarity on conductor stem leads 13 and 15 is reversed (i.e., 13 is neutral), outer lead 50 of ultraviolet light source 21 is connected to return lead 43 while a portion of envelope 45 is capacitively coupled to conductor lead 41. A point formed on the electrode, such as one of the corners of getter means 49, improves the field enhancement of the device.

To further increase the coupling surface area to envelope 45 or 45', a contact 57 (FIGS. 3A and 3B) is formed on the electrodeless side of the ultraviolet light source to capacitively couple the ultraviolet light source to one of the desired current carrying leads (e.g., return lead 43) of the lamp.

In the embodiment illustrated in FIGS. 3A and 3B, contact 57 is formed from a separate wire 58 helically wrapped around a portion of the external surface of envelope 45' of ultraviolet light source 21'. The remote end 59 of contact 57 is welded, for example, to return lead 43 of lamp 3. Alternatively, the coupling surface area can be increased by helically wrapping a portion of return lead 43 around a portion of the external surface of envelope 45 or 45' of the ultraviolet light source. A conductive mesh sleeve may also be used to optimize the coupling load impedance.

In a typical but non-limitative example of a metal halide arc discharge lamp containing a source of ultraviolet light in accordance with the teachings of the present invention, the lamp was a BU/BD M100 metal halide arc discharge lamp. The envelope of the ultraviolet light source was formed from 9741 borosilicate glass available from Corning Glass Works having an outside diameter of 0.236 inch (6.0 millimeters) and an inside diameter of 0.157 inch (4.0 millimeters). The envelope contained an argon fill at a pressure of approximately 10 torr. A single electrode was formed by attaching a 0.118 inch (3.0 millimeters) by 0.250 inch (6.35 millimeters) piece of ST101/ST505 to a 0.020 inch (0.50 millimeter) Kovar wire which extended through a direct seal located at one end of the envelope of the ultraviolet light source. A portion of envelope was in a contiguous relationship with the return lead of the lamp.

Figure 4:
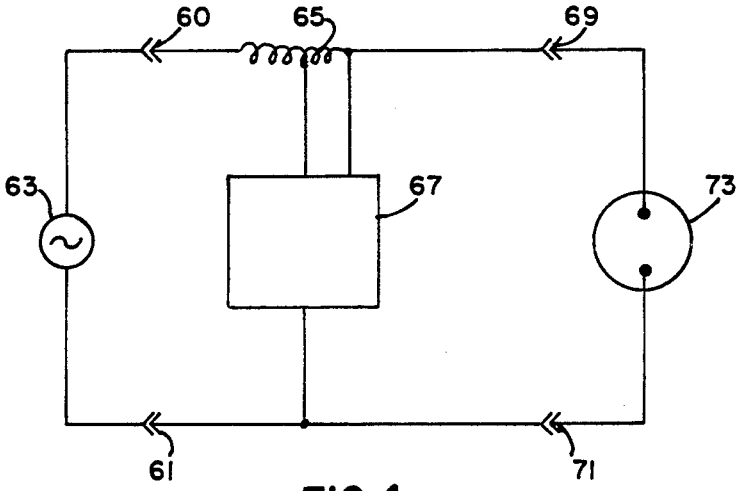
FIG. 4 is a schematic diagram of a metal halide arc discharge lamp assembly.

The dramatic effect of the ultraviolet radiation on the starting time between voltage application and the current flow through the lamp may be more fully appreciated by a comparison in the distribution of the starting times for lamps constructed with and without an ultraviolet light source of the present invention. Test lamps were measured on a known pulse circuit as illustrated in FIG. 4. As shown in FIG. 4, an A.C. voltage source 63 is applied to input terminals 60, 61. An inductive ballast 65, such as model no. 71A5380, is connected between input terminal 60 and one of the terminals 69 of lamp 73. An ignitor 67, such as model no. LI531, is connected across terminals 69, 71 of lamp 73 as shown in FIG. 4. The above-mentioned inductive ballast and ignitor are available from Advance Transformer Company, Chicago, Ill. A suitable ignitor produces at least three high voltage pulses per half cycle having an amplitude of at least 3300 volts and a pulse width of at least 2.0 microseconds.

Figure 5:
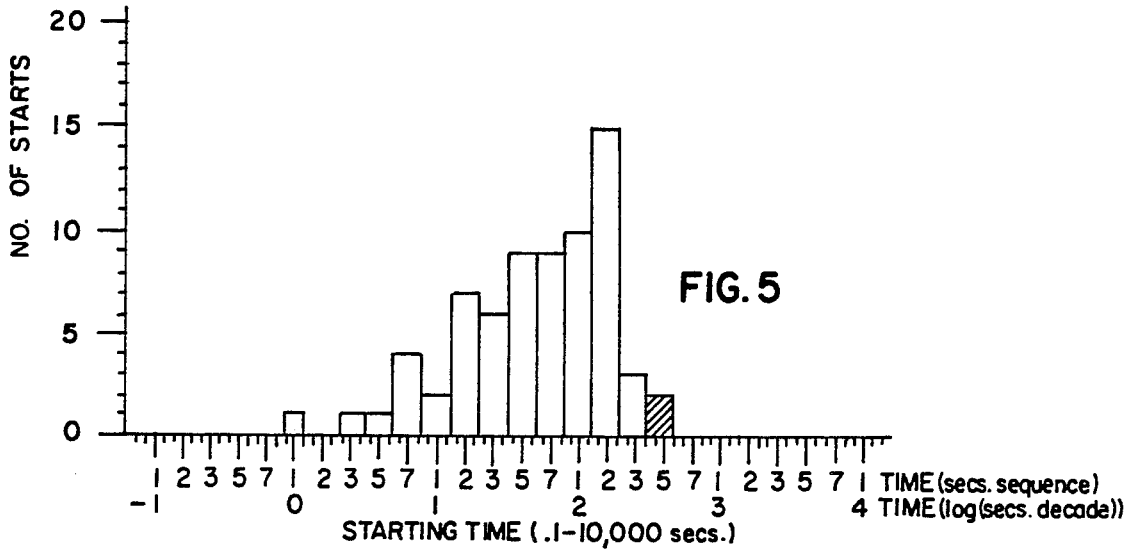
FIG. 5 is a histogram of the number of starts versus starting time for a metal halide arc discharge lamp without the ultraviolet light source of the present invention.

FIG. 5 is a histogram of the frequency distribution of starting times of a group of lamps, similar to that described in the above example but without the ultraviolet light source, measured on the pulse circuit of FIG. 4. FIG. 5 represents the result of starting each lamp of a ten lamp group seven times. The number of starts is plotted on the y-axis versus the starting time which is plotted on the x-axis on a logarithmic scale. The distribution ranges from an earliest time of about 1 second to a latest start time of 300 seconds. The hatched bar in FIG. 5 denotes two lamps which each failed to start on one occasion. The average starting time is 105.1 seconds.

Figure 6:
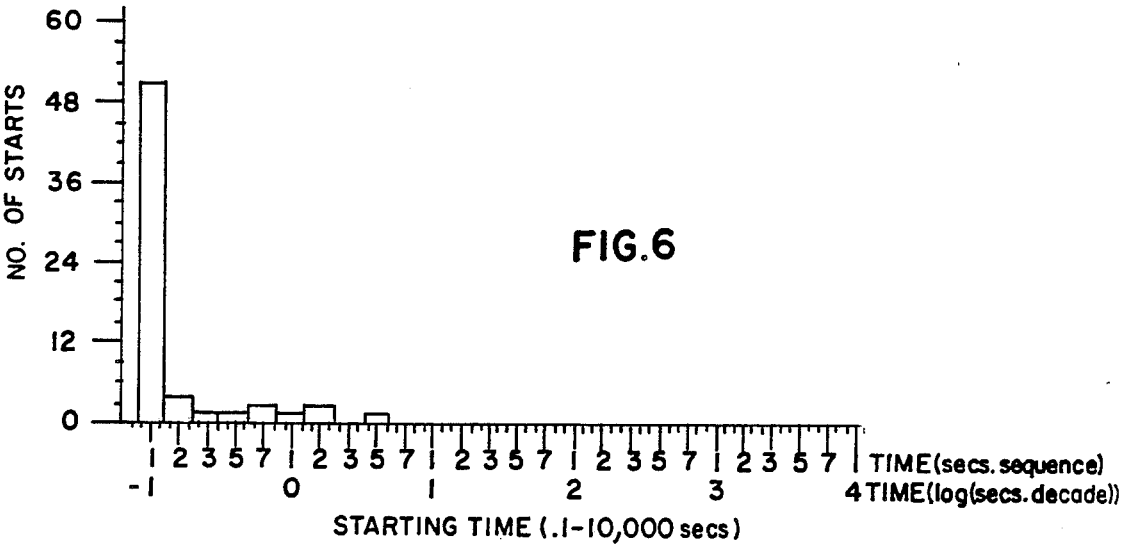
FIG. 6 is a histogram as in FIG. 5 but including an ultraviolet light source in accordance with the present invention.

In contrast, the histogram depicted in FIG. 6 shows the result of a second group of lamps tested on the same pulse circuit of FIG. 4. FIG. 6 represents data collected from a group of eight lamps similar to that described in the above example but containing the ultraviolet radiation light source. Each lamp was started eight times. The distribution is very narrowly centered at about 0.1 second. The average starting time is 0.3 second.

The pulse voltage required to start discharge, i.e., breakdown voltage, is reduced by the introduction of the ultraviolet light source described above.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A metal halide arc discharge lamp comprising:

an arc tube containing a chemical fill including mercury and metal halides and having first and second electrodes respectively sealed at opposite ends thereof;

an outer envelope surrounding said arc tube and having first and second terminals for electrical connection thereto;

means for electrically coupling said first electrode of said arc tube to said first terminal;

means for electrically coupling said second electrode of said arc tube to said second terminal; and a source of ultraviolet radiation within said outer envelope proximate said arc tube for producing radiation which illuminates the path between said electrodes of said arc tube to decrease the amount of time for generating a gaseous discharge therebetween, said source of ultraviolet radiation comprising an envelope of ultraviolet light transmitting material, a fill material contained within said envelope of said source of ultraviolet radiation, a single electrode sealed in said envelope of said source of ultraviolet radiation, and means for electrically coupling said single electrode of said source of ultraviolet radiation to said means for electrically coupling said first electrode of said arc tube to said first terminal, a portion of said envelope of said source of ultraviolet radiation being capacitively coupled to said means for electrically coupling said second electrode of said arc tube to said second terminal such that said source of ultraviolet radiation produces said ultraviolet radiation during lamp starting when said first and second terminals of said lamp are energized.

2. The metal halide arc discharge lamp of claim 1 wherein said portion of said envelope of said source of ultraviolet radiation is adjacent said means for electrically coupling said second electrode of said arc tube to said second terminal.

3. The metal halide arc discharge lamp of claim 1 wherein said portion of said envelope of said source of ultraviolet radiation and said means for electrically coupling said second electrode of said arc tube to said second terminal are in a contiguous relationship.

4. The metal halide arc discharge lamp of claim 1 wherein said envelope of said ultraviolet light source is quartz.

5. The metal halide arc discharge lamp of claim 1 wherein said envelope of said ultraviolet light source is Vycor.

6. The metal halide arc discharge lamp of claim 1 wherein said envelope of said ultraviolet light source is ultraviolet light transmitting borosilicate glass.

7. The metal halide arc discharge lamp of claim 6 wherein the transmission band of said borosilicate glass extends to a short wave length of 253.7 nanometers or less.

8. The metal halide arc discharge lamp of claim 1 wherein said source of ultraviolet radiation further includes a getter means located within said envelope of said ultraviolet light source and associated with said single electrode.

9. The metal halide arc discharge lamp of claim 1 wherein said means for electrically coupling said single electrode of said source of ultraviolet radiation to said means for electrically coupling said first electrode of said arc tube to said first terminal includes a foil sealed in one end of said envelope of said ultraviolet light source and a lead-in conductor attached to said foil and extending outside of said envelope of said ultraviolet light source.

10. The metal halide arc discharge lamp of claim 1 further including a contact means coupling said portion of the external surface of said envelope of said ultraviolet light source to said means for electrically coupling said second electrode of said arc tube to said second terminal.

11. The metal halide arc discharge lamp of claim 10 wherein said contact means is a conductive mesh sleeve.

12. The metal halide arc discharge lamp of claim 1 wherein said fill material within said envelope of said source of ultraviolet radiation includes a Penning mixture.

13. The metal halide arc discharge lamp of claims 1 or 8 wherein said single electrode has a pointed tip, sharp edge, or corner formed thereon to lower the breakdown voltage of said source of ultraviolet radiation.

14. A metal halide arc discharge lamp assembly for connection across an A.C. source, said assembly comprising:

a metal halide arc discharge lamp including an arc tube containing a chemical fill including mercury and metal halides and having first and second electrodes respectively sealed at opposite ends thereof, an outer envelope surrounding said arc tube and having first and second terminals for electrical connection thereto, means for electrically coupling said first electrode of said arc tube to said first terminal, means for electrically coupling said second electrode of said arc tube to said second terminal, and a source of ultraviolet radiation within said outer envelope proximate said arc tube for producing radiation which illuminates the path between said electrodes of said arc tube to decrease the amount of time for generating a gaseous discharge therebetween, said source of ultraviolet radiation comprising an envelope of ultraviolet light transmitting material, a fill material contained within said envelope of said source of ultraviolet radiation, a single electrode sealed in said envelope of said source of ultraviolet radiation, and a means for electrically coupling said single electrode of said source of ultraviolet radiation to said means for electrically coupling said first electrode of said arc tube to said first terminal, a portion of said envelope of said source of ultraviolet radiation being capacitively coupled to said means for electrically coupling said second electrode of said arc tube to said second terminal such that said source of ultraviolet radiation produces said ultraviolet radiation during lamp starting when said first and second terminals of said lamp are energized;

input terminals operable to be connected across said A.C. source;

an inductive ballast connected between one of said input terminals and said first terminal of said metal halide arc discharge lamp; and an ignitor means for generating high voltage pulses connected across said metal halide arc discharge lamp.

* * * * *